US008710721B1

(12) United States Patent
Li et al.

(10) Patent No.: US 8,710,721 B1
(45) Date of Patent: Apr. 29, 2014

(54) LIGHT EMITTING DEVICE

(71) Applicants: Yun-Li Li, Tainan (TW); Yi-Fan Li, Tainan (TW); Sheng-Yuan Sun, Tainan (TW)

(72) Inventors: Yun-Li Li, Tainan (TW); Yi-Fan Li, Tainan (TW); Sheng-Yuan Sun, Tainan (TW)

(73) Assignee: Genesis Photonics Inc., Tainan (TW)

( * ) Notice: Subject to any disclaimer, the term of this patent is extended or adjusted under 35 U.S.C. 154(b) by 0 days.

(21) Appl. No.: 13/773,648

(22) Filed: Feb. 22, 2013

(30) Foreign Application Priority Data

Dec. 12, 2012 (TW) ..... 101224088 U

(51) Int. Cl.
*F21V 29/00* (2006.01)
*F21V 29/02* (2006.01)

(52) U.S. Cl.
USPC ..... 313/35; 313/36; 362/294; 362/373; 362/345

(58) Field of Classification Search
USPC ..... 313/11–46; 362/294, 373, 345, 545
See application file for complete search history.

(56) References Cited

U.S. PATENT DOCUMENTS

| | | | | |
|---|---|---|---|---|
| 8,066,414 | B2 * | 11/2011 | Pabst et al. | 362/373 |
| 8,602,610 | B1 * | 12/2013 | Lauer | 362/392 |
| 2011/0298371 | A1 * | 12/2011 | Brandes et al. | 315/32 |
| 2012/0014098 | A1 * | 1/2012 | Breidenassel et al. | 362/249.01 |
| 2012/0051058 | A1 * | 3/2012 | Sharma et al. | 362/294 |
| 2013/0229801 | A1 * | 9/2013 | Breidenassel et al. | 362/235 |

FOREIGN PATENT DOCUMENTS

| | | | |
|---|---|---|---|
| CN | 202040621 U | * | 11/2011 |
| CN | 102526793 A | * | 7/2012 |
| CN | 203099440 U | * | 7/2013 |

* cited by examiner

*Primary Examiner* — Mariceli Santiago
(74) *Attorney, Agent, or Firm* — Jianq Chyun IP Office

(57) ABSTRACT

A light emitting device includes a light-emitting diode (LED) light source module, a heat-dissipating unit and a phosphor-converted cover. The heat-dissipating unit is disposed below the LED light source module. The phosphor-converted cover covers the LED light source module. The phosphor-converted cover has an accommodating space, at least one air channel and a first air hole. The LED light source module is located in the accommodating space, and the first air hole is located above the LED light source module and connected to the air channel. An outside fluid passes through the accommodating space via the air channel to discharge heat generated by the LED light source module to outside via the first air hole. An aperture of the first air hole is between 0.01 millimeters and 1 millimeter.

12 Claims, 3 Drawing Sheets

LIGHT EMITTING DEVICE

CROSS-REFERENCE TO RELATED APPLICATION

This application claims the priority benefit of Taiwan application serial no. 101224088, filed on Dec. 12, 2012. The entirety of the above-mentioned patent application is hereby incorporated by reference herein and made a part of this specification.

BACKGROUND OF THE INVENTION

1. Field of the Invention

The invention relates to a light emitting device, more particularly, to a light emitting device utilizing a light-emitting diode as a light source.

2. Description of Related Art

With development of optoelectronic techniques, light emitting mechanism of light emitting devices has evolved from thermoluminescence into electroluminescence (EL). Light emitting devices with electroluminescence mechanism usually emit light in different colors by using a phosphor, which is a common method used for converting a wavelength of the light emitted by the light emitting device.

In regard to an LED illuminating device, a phosphor-converted cover is usually disposed above an LED light source module so as to emit light in different colors. A white-light conversion may then begin once the light emitted from the LED light source module is emitted to the phosphor-converted cover. However, heat generated by the LED light source module and heat generated during the white-light conversion may both be accumulated on the phosphor-converted cover, causing temperature of the phosphor-converted cover to rise. Since the phosphor-converted cover is composed by a phosphor and a high-molecular material or a glass, an effect of thermal quenching of luminescence may occur when the temperature of the phosphor-converted cover rises. As a result, efficiency of a phosphor-conversion may be reduced thereby generating a color washout phenomenon.

SUMMARY OF THE INVENTION

The invention is directed to a light emitting device having favorable efficiency in heat dissipation and capable of reducing color washout phenomenon.

The invention provides a light emitting device including a light-emitting diode (LED) light source module, a heat-dissipating unit and a phosphor-converted cover. The heat-dissipating unit is disposed below the LED light source module. The phosphor-converted cover covers the LED light source module. The phosphor-converted cover has an accommodating space, at least one air channel and a first air hole. The LED light source module is located in the accommodating space, and the first air hole is located above the LED light source module and connected to the air channel. An aperture of the first air hole is between 0.01 millimeters and 1 millimeter.

According to an embodiment of the invention, the phosphor-converted cover is fixed on the heat-dissipating unit, and the air channel is defined between the phosphor-converted cover and the heat-dissipating unit.

According to an embodiment of the invention, the phosphor-converted cover is fixed on the LED light source module, and the air channel is defined between the phosphor-converted cover and the LED light source module.

According to an embodiment of the invention, the at least one air channel includes a plurality of air channels, the phosphor-converted cover has a plurality of second air holes connected to each other, and the plurality of second air holes are located at a bottom edge of the phosphor-converted cover, and the plurality of air channels are defined by the plurality of second air holes and the LED light source module, and the bottom edge is directly contacted with the LED light source module.

According to an embodiment of the invention, a number of the second air holes is at least two.

According to an embodiment of the invention, the second air holes are arranged at equidistant intervals.

According to an embodiment of the invention, an aperture of each of the second air holes is between 0.01 millimeters and 1 millimeter.

According to an embodiment of the invention, the heat-dissipating unit has an upper surface, and the LED light source module is disposed on the upper surface. An area confined by the bottom edge of the phosphor-converted cover is 0.5 times to 0.9 times a surface area of the upper surface of the heat-dissipating unit.

According to an embodiment of the invention, a shape of the phosphor-converted cover is a hemisphere.

According to an embodiment of the invention, the LED light source module includes a substrate and at least one light-emitting diode (LED) chip. The LED chip is disposed on the substrate and electrically connected to the substrate.

According to an embodiment of the invention, the substrate includes an aluminum substrate, a copper substrate, a ceramic substrate, a glass fiber substrate or a printed circuit board.

According to an embodiment of the invention, the heat-dissipating unit includes a heat-dissipating block, a heat-dissipating sink, a heat-dissipating plate body or a heat pipe.

Based on above, since the phosphor-converted cover has the air channel and the air hole connected to each other, heat generated by the LED light source module may be transferred to outside through the heat-dissipating unit, an outside fluid may also pass through the accommodating space via the air channel, so as to discharge heat generated by the LED light source module to outside via the air hole by convection effect which reduces the temperature in the accommodating space. Accordingly, the light emitting device of the invention may have improved heat-dissipating efficiency and efficiency of a phosphor-conversion of the phosphor-converted cover may also be improved to reduce color washout phenomenon.

Several exemplary embodiments accompanied with figures are described in detail below to further describe the invention in details.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the invention.

DESCRIPTION OF THE EMBODIMENTS

Figure 1A:
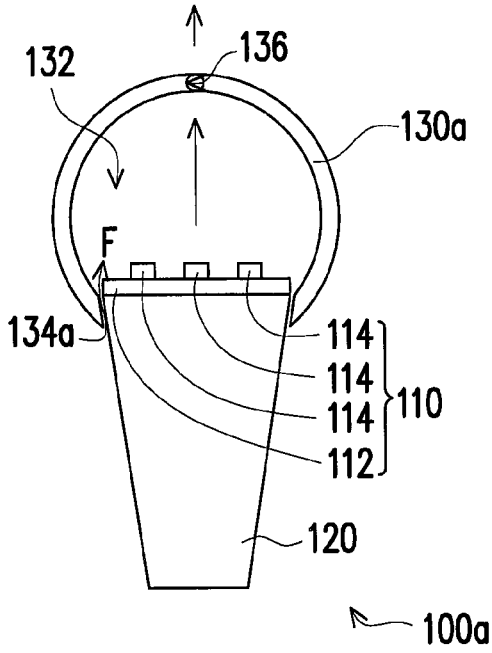
FIG. 1A is a schematic cross-sectional view illustrating a light emitting device according to an embodiment of the invention.
Figure 1B:
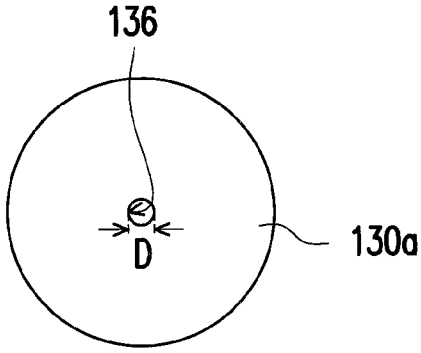
FIG. 1B is a top view illustrating a phosphor-converted cover of the light emitting device depicted in FIG. 1A.

FIG. 1A is a schematic cross-sectional view illustrating a light emitting device according to an embodiment of the invention. FIG. 1B is a top view illustrating a phosphor-converted cover of the light emitting device depicted in FIG. 1A. Referring to FIG. 1A and FIG. 1B together, a light emitting device 100*a* includes a light-emitting diode (LED) light source module 110, a heat-dissipating unit 120 and a phosphor-converted cover 130*a*. The heat-dissipating unit 120 is disposed below the LED light source module 110. The phosphor-converted cover 130*a* covers the LED light source module 110. The phosphor-converted cover 130*a* has an accommodating space 132, at least one air channel 134*a* and a first air hole 136. The LED light source module 110 is located in the accommodating space 132, and the first air hole 136 is located above the LED light source module 110 and connected to the air channel 134*a*. An outside fluid F is suitable to pass through the accommodating space 132 via the air channel 134*a* to discharge heat generated by the LED light source module 110 to outside via the first air hole 136. More preferably, an aperture D of the first air hole 136 is between 0.01 millimeters and 1 millimeter.

More specifically, the LED light source module 110 of the present embodiment includes a substrate 112 and at least one light-emitting diode (LED) chip 114, in which the LED chip 114 is disposed on the substrate 112 and electrically connected to the substrate 112. Herein, the substrate 112 is, for example, an aluminum substrate, a copper substrate, a ceramic substrate, a glass fiber substrate or a printed circuit board. The heat-dissipating unit 120 is disposed below the LED light source module 110, in which heat generated by the LED chip 114 may be transferred to outside through the heat-dissipating unit 120 in form of thermal conduction. Herein, the heat-dissipating unit 120 is, for example, a heat-dissipating block, a heat-dissipating sink, a heat-dissipating plate body or a heat pipe. More specifically, according to the present embodiment, the phosphor-converted cover 130*a* is fixed on the heat-dissipating unit 120, and the air channel 134*a* is defined by the phosphor-converted cover 130*a* and the heat-dissipating unit 120. Herein, a shape of the phosphor-converted cover 130*a* is, for example, a hemisphere; and a method used to fix the phosphor-converted cover 130*a* on the heat-dissipating unit 120 may be, for example, latching, locking or adhering, the invention is not limited thereto.

Since the phosphor-converted cover 130*a* has the air channel 134*a* and the first air hole 136 connected to each other, heat generated by the LED light source module 110 may be transferred to outside through the heat-dissipating unit 120, and the outside fluid F may also pass through the accommodating space 132 via the air channel 134*a*, so as to discharge heat generated by the LED light source module 110 to outside via the first air hole 136 by stack effect which increases convection to reduce temperature in the accommodating space 132. Accordingly, the light emitting device 100*a* of the present embodiment may have improved heat dissipation efficiency and efficiency of a phosphor-conversion of the phosphor-converted cover 130*a* may also be improved to reduce color washout phenomenon. In addition, the aperture D of the first air hole 136 is between 0.01 millimeters and 1 millimeter, and a location of the air channel 134*a* is substantially lower than a location of the LED light source module 110, as shown in FIG. 1A. Therefore, this design of the air channel 134*a* and the first air hole 136 will not cause the light emitting device 100*a* to generate a light-leaking phenomenon.

It should be noted that, structures and positions of the phosphor-converted cover 130*a* are not particularly limited in the invention, even though the air channel 134*a* of the phosphor-converted cover 130*a* as embodied above is defined as an interval between the phosphor-converted cover 130*a* and the heat-dissipating unit 120 while having the phosphor-converted cover 130*a* fixed on the heat-dissipating unit 120. However, in other embodiments not shown, the phosphor-converted cover may also be fixed on the LED light source module, and the air channel of the phosphor-converted cover may also be defined as an interval between the phosphor-converted cover and the LED light source module. Said embodiment still belongs to a technical means adoptable in the present invention and falls within the protection scope of the present invention.

Moreover, it should be noted that, a profile of the first air hole 136 of the present embodiment is a circle as shown in FIG. 1B when viewing from atop, thus the aperture D of the first air hole 136 is substantially a diameter of the first air hole 136. However, in other embodiments, the profile of the first air hole 136 may also be other shapes when viewing from atop. In that case, the aperture D of the first air hole 136 is substantially a maximal length of the first air hole 136. Moreover, in other applications, the light emitting device 100*a* of the present embodiment may also be suspended on the ceiling or the wall for lighting. In this case, the outside fluid F is suitable to pass through the accommodating space 132 via the first air hole 136 to discharge heat generated by the LED light source module 110 to outside via the air channel 134*a*. Said embodiment still belongs to a technical means adoptable in the present invention and falls within the protection scope of the present invention.

Figure 2A:
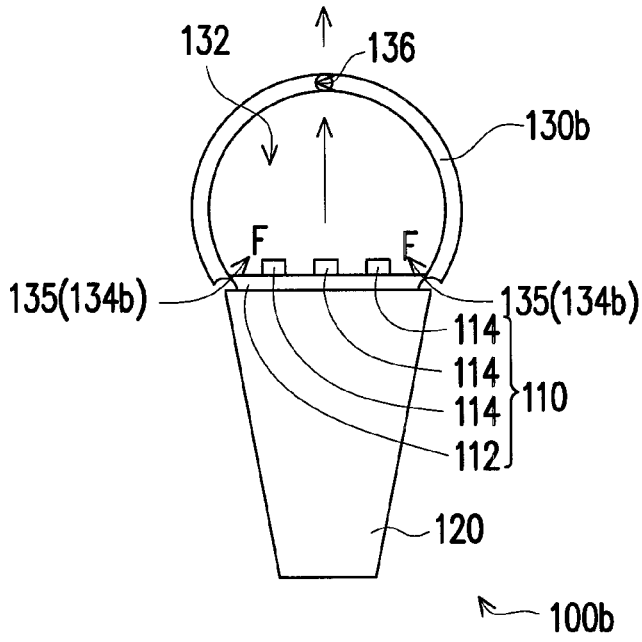
FIG. 2A is a schematic cross-sectional view illustrating a light emitting device according to an embodiment of the invention.
Figure 2B:
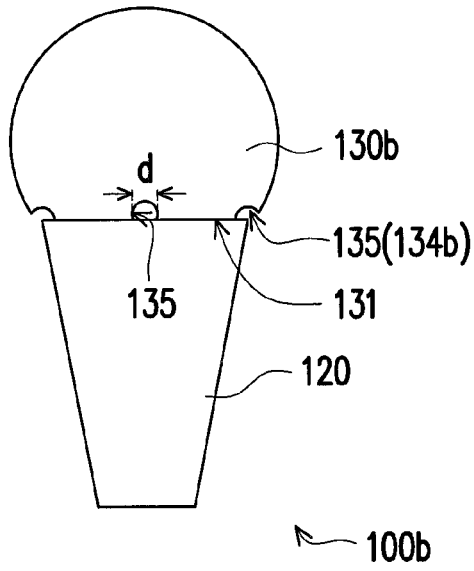
FIG. 2B is a side view illustrating the light emitting device depicted in FIG. 2A.

Referring to FIG. 2A and FIG. 2B together, as another embodiment of the invention, a phosphor-converted cover 130*b* of a light emitting device 100*b* is fixed on the LED light source module 110, the phosphor-converted cover 130*b* has a plurality of second air holes 135 connected to each other, and a plurality of air channels 134*b* are defined by the plurality of second air holes 135 and the LED light source module 110. More specifically, the second air holes 135 are located at a bottom edge 131 of the phosphor-converted cover 130*b*, and the bottom edge 131 is directly contacted with the LED light source module 110. Herein, a number of the second air holes 135 is at least two, for example, four; and the second air holes 135 are arranged at equidistant intervals. As a result, airflow may be evenly distributed so as to improve dissipation efficiency. Herein, an aperture d of each of the second air holes 135 is between 0.01 millimeters and 1 millimeter.

Figure 3:
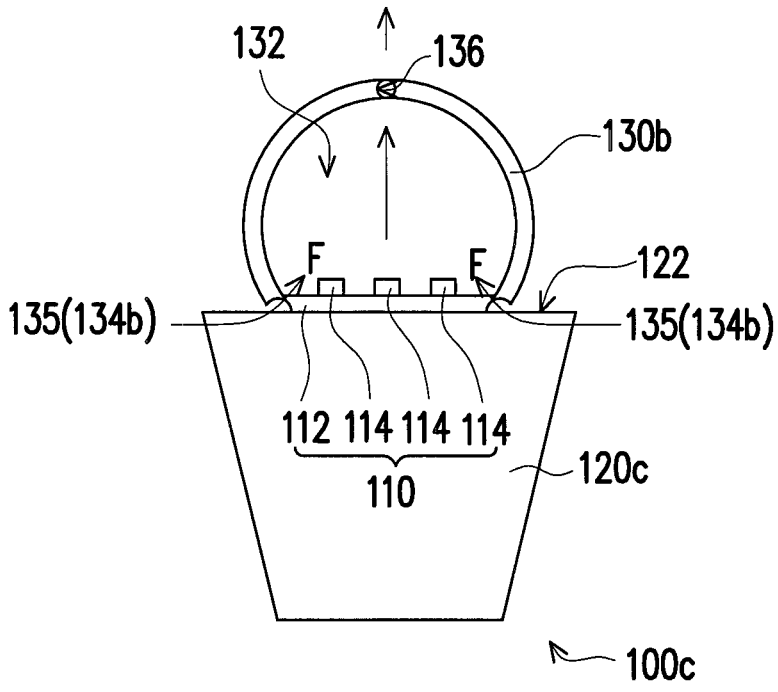
FIG. 3 is a schematic cross-sectional view illustrating a light emitting device according to another embodiment of the invention.

It should be noted that, relation between an area confined by the bottom edge 131 of the phosphor-converted cover 130*b* and a surface area of a surface contacted with the heat-dissipating unit 120 is not particularly limited in the invention. Although, the area confined by the bottom edge 131 of the phosphor-converted cover 130*b* as embodied above is substantially equal to or slightly less than the surface area of the surface contacted with the heat-dissipating unit 120. However, in other embodiments, referring to FIG. 3, the LED light source module 110 of a light emitting device 100*c* is disposed on a upper surface 122 of a heat-dissipating unit 120*c*, and an area confined by the bottom edge 131 of the phosphor-converted cover 130*b* is 0.5 times to 0.9 times the surface area of the upper surface 122 of the heat-dissipating unit 120*c*. In other words, the surface area of the upper surface 122 of the heat-dissipating unit 120*c* is substantially greater than the area confined by the bottom edge 131 of the phosphor-converted cover 130*b*. Said embodiment still belongs to a technical means adoptable in the present invention and falls within the protection scope of the present invention.

In view of above, since the phosphor-converted cover has the air channel and the air hole connected to each other, heat generated by the LED light source module may be transferred to outside through the heat-dissipating unit, the outside fluid may also pass through the accommodating space via the air channel, so as to discharge heat generated by the LED light source module to outside via the air hole by convection effect which reduces the temperature in the accommodating space. Alternatively, the outside fluid may pass through the accommodating space via the air hole to discharge heat generated by the LED light source module to outside via the air channel. Accordingly, the light emitting device of the invention may have improved dissipation efficiency and efficiency of a phosphor-conversion of the phosphor-converted cover may also be improved to reduce color washout phenomenon.

It will be apparent to those skilled in the art that various modifications and variations can be made to the structure of the disclosed embodiments without departing from the scope or spirit of the invention. In view of the foregoing, it is intended that the disclosure cover modifications and variations of this specification provided they fall within the scope of the following claims and their equivalents.

What is claimed is:

1. A light emitting device, comprising:

a light-emitting diode (LED) light source module;

a heat-dissipating unit disposed below the LED light source module; and a phosphor-converted cover covering the LED light source module, the phosphor-converted cover has an accommodating space, at least one air channel and a first air hole, the LED light source module is located in the accommodating space, and the first air hole is located above the LED light source module and connected to the air channel, wherein an aperture of the first air hole is between 0.01 millimeters and 1 millimeter.

2. The light emitting device as recited in claim 1, wherein the phosphor-converted cover is fixed on the heat-dissipating unit, and the air channel is defined between the phosphor-converted cover and the heat-dissipating unit.

3. The light emitting device as recited in claim 1, wherein the phosphor-converted cover is fixed on the LED light source module, and the air channel is defined between the phosphor-converted cover and the LED light source module.

4. The light emitting device as recited in claim 1, wherein the at least one air channel comprises a plurality of air channels, the phosphor-converted cover has a plurality of second air holes connected to each other, and the plurality of second air holes are located at a bottom edge of the phosphor-converted cover, and the plurality of air channels are defined by the plurality of second air holes and the LED light source module, and the bottom edge is directly contacted with the LED light source module.

5. The light emitting device as recited in claim 4, wherein a number of the second air holes is at least two.

6. The light emitting device as recited in claim 4, wherein the second air holes are arranged at equidistant intervals.

7. The light emitting device as recited in claim 4, wherein an aperture of each of the second air holes is between 0.01 millimeters and 1 millimeter.

8. The light emitting device as recited in claim 4, wherein the heat-dissipating unit has an upper surface, and the LED light source module is disposed on the upper surface, an area confined by the bottom edge of the phosphor-converted cover is 0.5 times to 0.9 times a surface area of the upper surface of the heat-dissipating unit.

9. The light emitting device as recited in claim 1, wherein a shape of the phosphor-converted cover is a hemisphere.

10. The light emitting device as recited in claim 1, wherein the LED light source module comprises:

a substrate; and at least one light-emitting diode chip disposed on the substrate and electrically connected to the substrate.

11. The light emitting device as recited in claim 10, wherein the substrate comprises an aluminum substrate, a copper substrate, a ceramic substrate, a glass fiber substrate or a printed circuit board.

12. The light emitting device as recited in claim 1, wherein the heat-dissipating unit comprises a heat-dissipating block, a heat-dissipating sink, a heat-dissipating plate body or a heat pipe.

* * * * *